US005902958A

United States Patent [19]

Haxton

[11] Patent Number: 5,902,958

[45] Date of Patent: May 11, 1999

[54] ARRANGEMENT IN A CABLE

[75] Inventor: Maurice M. Haxton, Kongsberg, Norway

[73] Assignee: Norsk Subsea Cable As, Norway

[21] Appl. No.: 08/843,279

[22] Filed: Apr. 14, 1997

[30] Foreign Application Priority Data

Apr. 26, 1996 [NO] Norway ..... 961678

[51] Int. Cl.[6] ..... H01B 7/20

[52] U.S. Cl. ..... 174/47; 138/110; 385/112

[58] Field of Search ..... 174/172 LF, 113 C, 174/116, 47; 138/110, 111; 385/112

[56] References Cited

U.S. PATENT DOCUMENTS

| | | | |
|---|---|---|---|
| 1,955,692 | 4/1934 | Thomas | 174/13 |
| 4,196,307 | 4/1980 | Moore et al. | 174/47 |
| 5,133,034 | 7/1992 | Arroyo et al. | 385/107 |
| 5,146,982 | 9/1992 | Dinkins | 166/65.1 |
| 5,362,921 | 11/1994 | Birkelund et al. | 174/47 |
| 5,390,273 | 2/1995 | Rahman et al. | 385/112 |

FOREIGN PATENT DOCUMENTS

| | | | |
|---|---|---|---|
| 155826 | 6/1987 | Norway | F16L 9/19 |
| 174940 | 6/1989 | Norway | F16L 9/18 |
| 369621 | 11/1970 | Sweden | F16L 9/18 |
| 1594702 | 8/1981 | United Kingdom | 174/47 |

*Primary Examiner*—Dean A. Reichard
*Assistant Examiner*—Dhiru R. Patel
*Attorney, Agent, or Firm*—Volpe and Koenig, P.C.

[57] ABSTRACT

The present invention relates to an arrangement in a cable, especially a hydro electric control cable, which has a plurality of hydraulic tubes and electrical cables. In order to arrive at such an arrangement which allows for a required volume of service fluid while retaining an optimum minimum bending radius, the present invention suggests that the cable is designed as an umbilical (1, 101) with three centrally arranged tubes (2) in helical configuration which are surrounded by a ring of electrical cables and hydraulic tubes to allow for lower minimum bend radius (MBR).

16 Claims, 4 Drawing Sheets

ARRANGEMENT IN A CABLE

FILED OF THE INVENTION

The present invention relates to an arrangement in a cable, especially, a hydro electric control cable, comprising in combination a plurality of hydraulic tubes and electrical cables.

PRIOR ART

Prior art umbilicals are known, both of the type wherein a plurality of cables and hydraulic tubes are used in one unit, and of the type wherein electrical cables and hydraulic tubes are arranged as separate units.

From NO 174.940 (Hauger et al./Kværner) there is known a pipe handle arrangement wherein pipes and cables are arranged in helical configuration around a central core.

NO 155.826 (Bognes et al./Kværner) relates to a pipe handle cable for subsea application, comprising a plurality of rigid pipes in helical configuration, a filler therebetween and an outer protecting sheath.

SE 369 621 (Hotz et al./Kabel- und Lackdrahtfabriken GmbH) relates to a pipe bundle, comprising a central configuration or inner layer of three pipe elements and an outer layer of nine pipes, said pipes being made of polythene, and all of which are strapped by a polyester foil and covered by outer layers of insulation.

SUMMARY OF THE INVENTION

The present umbilical is suitable for both static and dynamic applications. The design is based on experience from earlier work with both flexible and rigid tubes.

The objective is to achieve a flexible design which will meet the varying demands of the industry, and which can be produced using known production techniques, e.g. welding cabling, etc.

The final design is made in two discrete operations, and comprises a central service core around which the electrical cables and hydraulic tubes and cabled.

The minimum bend radius (MBR) is one of the most important parameters from both the production and installation viewpoints, and a compromise is reached that allows for the transport of the required volume of service fluid while retaining an acceptable minimum bend radius.

Where dynamic application is required the umbilical will be produced in a single length of static umbilical and the additional layers required for the dynamic section applied. This eliminates the need for factory splicing of the dynamic to the static sections.

Further objects and advantages of the present invention will appear from the following description taken in connection with the enclosed drawings, as well as from the appended patent claims.

BRIEF DISCLOSURE OF THE DRAWINGS

DESCRIPTION OF EMBODIMENTS

Figure 1:
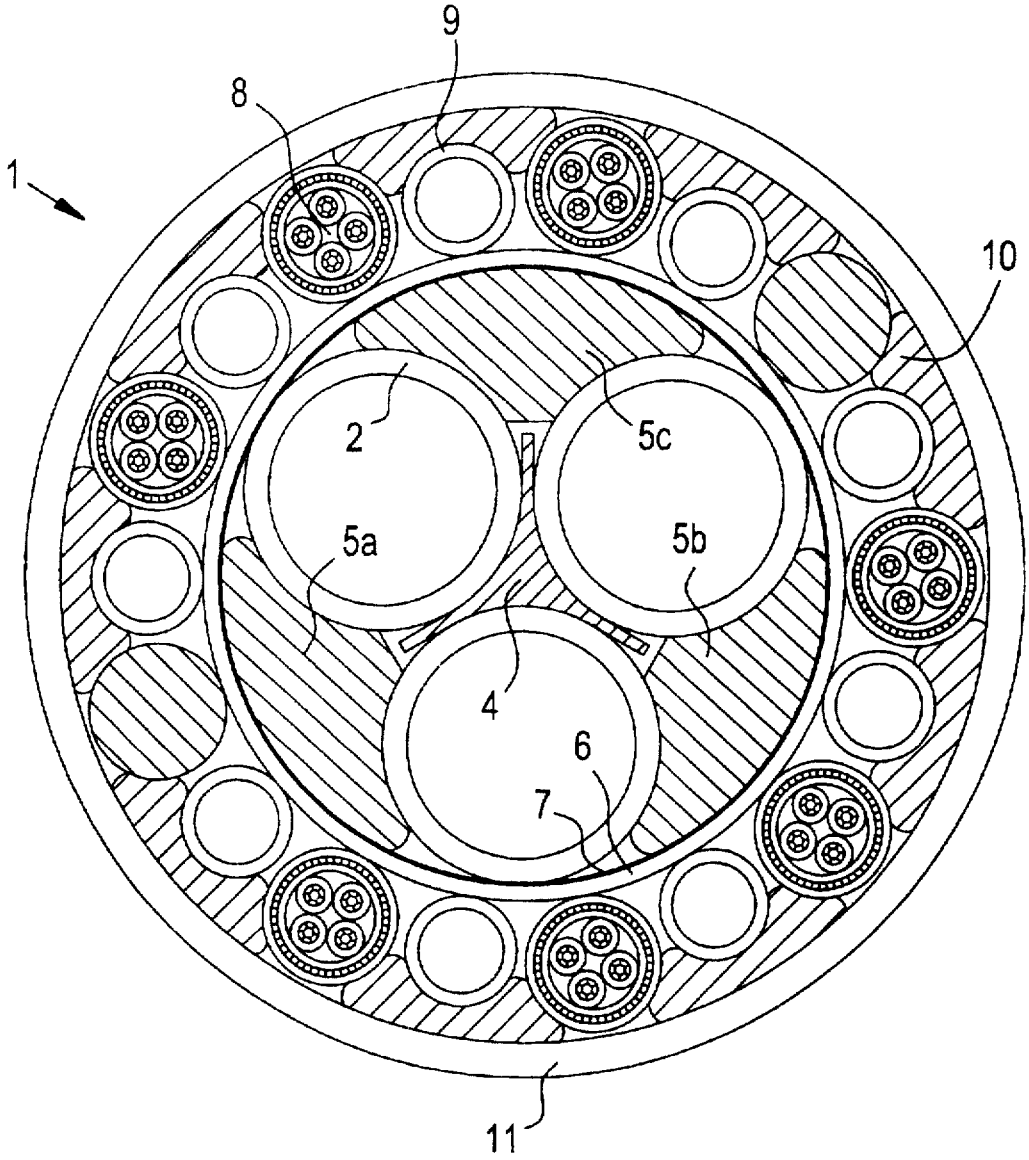
FIG. 1 is a section through a first embodiment of an arrangement in a cable, especially a static section.
Figure 2:
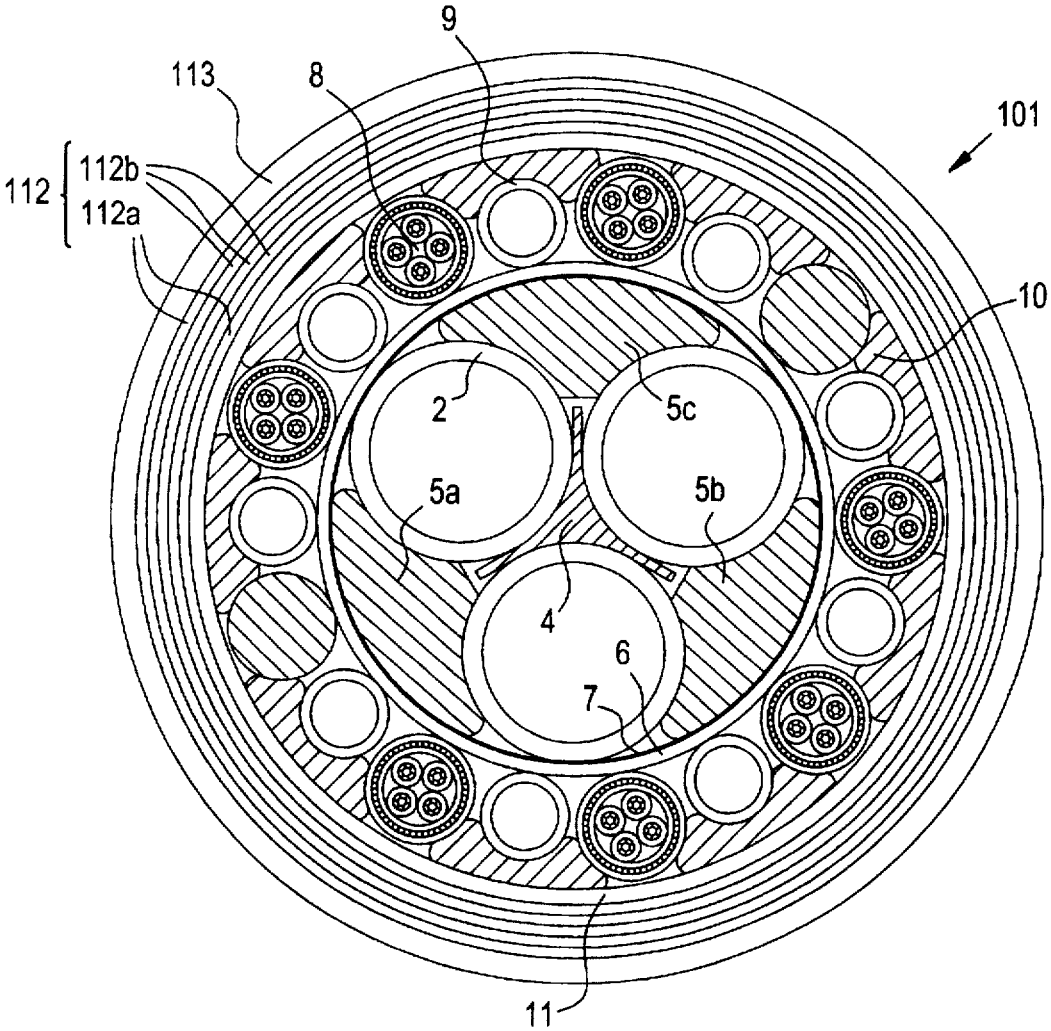
FIG. 2 is a section through a second embodiment of an arrangement in a cable, especially a dynamic section.
Figure 3:
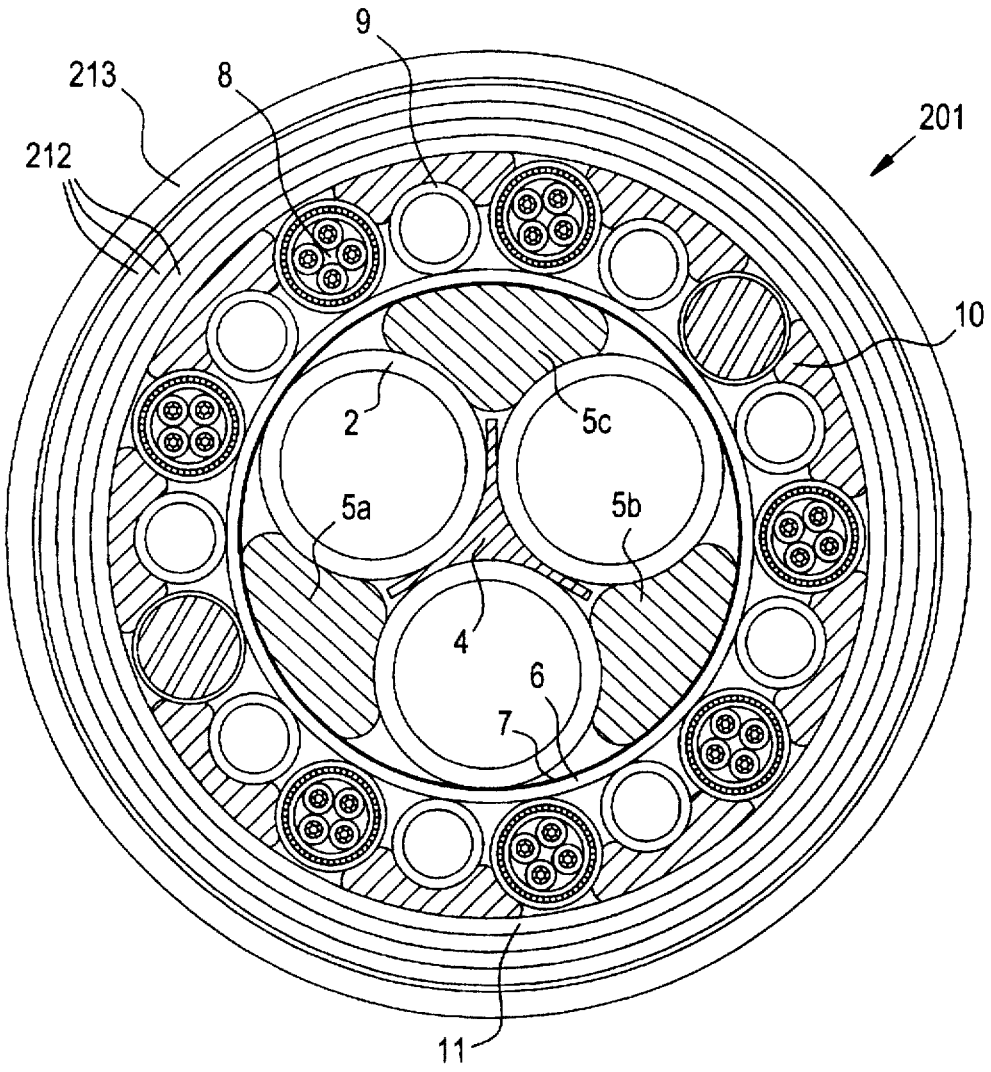
FIG. 3 is a section through a third embodiment of an arrangement in a cable, especially a dynamic section.

In FIG. 1, FIG. 2 and FIG. 3 the three embodiments of the combined hydro electric cable 1, 101, 201, respectively, are designed as follows.

Central Service Core

Centre filler: A single profiled filler 4 designed to separate the three centre tubes 2, this filler 4 will simplify cabling and ensure a low friction between the tubes 2.

Service tubes: The three Super Duplex tubes 2 are cabled in helical configuration. This gives a very flexible umbilical, thereby a considerably lower Minimum Bend Radius compared to that of one equivalent large centre tube (i.e. approx. 40% lower).

Profiled fillers: Three PE fillers 5*a*, 5*b*, 5*c* are designed to support the PE sheath 6 and to produce a firm circular section.

Extruding tape: This tape 7 is designed to totally cover the tube 2 and filler bundle 4, 5*a*, 5*b*, 5*c* and makes a stable bed for the PE inner sheath extruding 6.

Inner PE sheath: This sheath 6 is designed to encapsulate the centre tubes and provide a good bed for the cabling of the outer tubes 9 and quads 8. The sheath 6 also provides a secure separation between the centre tubes 2 and the outer tubes 8, 9.

Electrical Cables and Hydraulic Tubes

Electric quads: Seven quads 8 of 6 $mm^2$ with individual armouring ensure the electrical cables will sustain quite severe dynamic bending and crushing loads.

Hydraulic tubes: Nine Super Duplex or Multi Steel tubes 9 cabled in helical configuration, achieving good flexural properties and ensures that the cabled tubes 9 remain stable in the construction.

Profiled filler: Nine fillers 10 over the hydraulic tubes 9 ensure that the electric cables 8 are afforded a degree of protection against external forces. Designed to give a firm circular section.

Outer and/or intermediate sheath: Extruded PE outer or intermediate sheath 11 with a minimum of 5 mm thickness.

DYNAMIC SECTION (As above but with the following additional layers), see FIG. 2 and FIG. 3.

Ballast layers: Multi-helical wound layers 112, 212 of steel 112*a* or 112*b* tape to achieve the require weight/diameter ratio. The tape 112*a*, 112*b* is applied directly to the static section for the desired dynamic length.

Dynamic sheath: Extruded PU dynamic sheath 113, 213, respectively, over the ballast layers 112, 212 with a minimum of 5 mm thickness.

Figure 4:
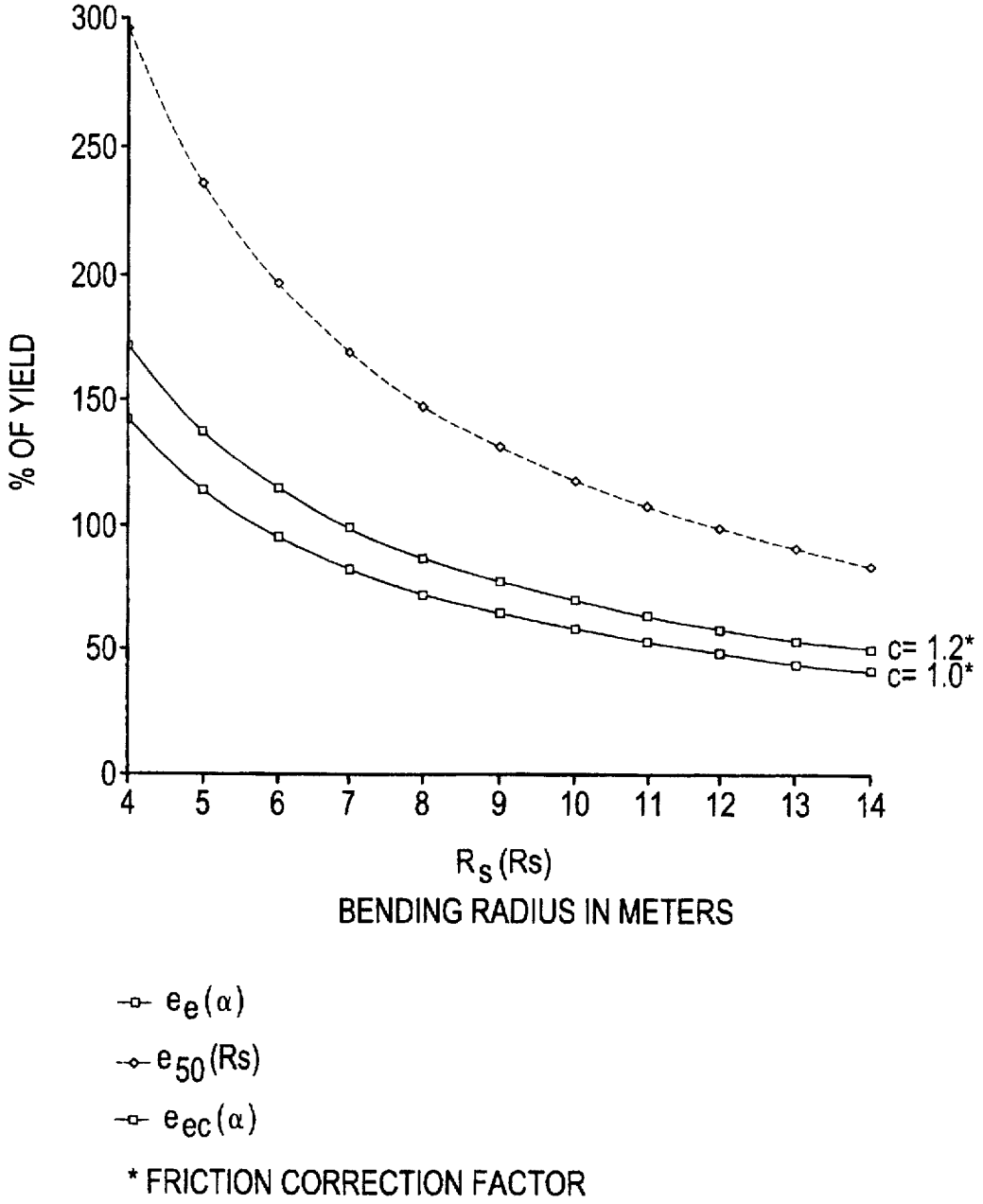
FIG. 4 is a graph illustrating per cent of yield versus bending radius for helical wire stresses in bent cables.

A further detailed specification of the disclosed embodiments will be given in the following, wherein reference is also made to FIG. 4 showing the calculation of minimum umbilical bending radius with different friction correction factors. As shown in FIGS. 2 and 3 and specified below, the outer diameter $D_{el}$ of the electrical cables 8 is preferably greater than the outer diameter $D_t$ of the hydraulic lines 9 and both are preferably smaller in diameter than the outer diameter $D_{cl}$ of the central tubes 2.

Technical Description

Technical data

Caculated Umbiblical 1, 101, 201 properties (nominal):

| Description | Static Section | Dynamic section |
|---|---|---|
| Weight in air (all lines filled) [kg/m] | 31 | 81 |
| Weight in water [kg/m] | 14 | 59 |
| Axial stiffness [N] | | |
| Bending stiffness (incl. friction) | | |

-continued

| Description | Static Section | Dynamic section |
|---|---|---|
| [Nm²] | | |
| Torsional stiffness [Nm²] | | |
| Minimum breaking load [kN] | 594.5 | 594.5 |
| Max. allowable installation load at min. bend radius [kN] | | |
| Max. allowable pull-in load [kN] | 200 | 200 |
| Min. bend radius - storage [mm] | 6.75 | 6.75 |
| Min. bend radius - handling [mm] | Depending on tension | |
| Elongation versus tensile load (calculated) [mm/m/kN] | | |
| Max. applied torsion (twist) | Maximum 2 degrees per meter umbilical at 25% of min. breaking load (see above) | |

Tubes 2, 9:

| Function | Line no. | Min. ID (mm) | WP (Bar) |
|---|---|---|---|
| Methanol | 1 | 33 | 517 |
| Methanol | 2 | 33 | 517 |
| Methanol | 3 | 33 | 517 |
| Hydraulic fluid | 4 | 12.7 | 690 |
| Hydraulic fluid | 5 | 12.7 | 690 |
| Corrosion Inhibitor | 6 | 12.7 | 690 |
| Emulsion Breaker Inhibitor | 7 | 12.7 | 690 |
| Scale/Wax Inhibitor | 8 | 12.7 | 690 |
| Scale/Wax Inhibitor | 9 | 12.7 | 690 |
| Annulus Bleed | 10 | 12.7 | 690 |
| Spare | 11 | 12.7 | 690 |
| Spare | 12 | 12.7 | 690 |

Minimum Hydraulic fluid and Spare lines will be filled with Control fluid at the time of load-out.

Electrical cables 8:

7 off 6 mm² armoured jelly filled quads.

5.2 Umbilical description 5.2.1 Electrical cable 8:

The electrical cable consists of the following elements:

Centre filler made of PE, four conductors built up with 7 cabled copper strands with insulation of PE, and polypropylene filler yarns in the interstices.

Petrojelly is applied between the copper strands. The purpose of the jelly is to lubricate the insulated conductors and prevent longitudinal penetration of water along the conductors. Polyester tape is added onto the conductors and fillers and the quad is covered of a PE inner sheath.

One layers of galvanised armour wire will be helically winded onto the inner sheath before the outer sheath is extruded to protect the conductors against axial and crush forces.

| | |
|---|---|
| Outer diameter (nom.) | $D_{e1}$ = 20 mm |

5.2.2 Steel tubes 2, 9:

Center lines 2:

The center tubing (methanol line) is delivered in approx. 16 m lengths from the steel work. These steel tubes will be welded to continuous length for each line, and each line shall be longitudinal marked every 0.5 m.

Each umbilical will consist of three center lines with the following dimensions.

| | |
|---|---|
| Outer diameter (nom.) | $D_{e1}$ = 39.4 mm |
| Inner diameter (nom.) | $d_{e1}$ = 33 mm |

Hydraulic lines 9:

The hydraulic tubing is delivered in approx. 36 m lengths from the steel work. These steel tubes will be welded to continuous length for each line, and each line shall be longitudinal marked every 0.5 m.

Each umbilical will consist of nine hydraulic lines with the following dimensions.

| | |
|---|---|
| Outer diameter (nom.) | $D_t$ = 16.5 mm |
| Inner diameter (nom.) | $d_t$ = 12.7 mm |

All tubes are made of Super Duplex with the following mechanical properties:

| | |
|---|---|
| Modulus of elasticity | $E_t$ = 200 000 MPa |
| Yield strength (min.) | $\sigma_y$ = 600 MPa |
| Tensile strength (min.) | $\sigma_b$ = 800 MPa |
| Elongation at break (min.) | $\epsilon_{A5}$ = 25% |

5.2.3 Fillers 4, 5a, 5b, 5c

Four profiled fillers made of PE is placed between the center tubes. The purpose of these fillers is to avoid contact between the steel tubes and to keep the tubes in position.

Two off circular fillers placed in the outer bundle. For the static section the circular fillers are made of PE and of PE coated lead for the dynamic section.

5.2.4 Inner sheath 6

The inner sheath is extruded outside the three center tubes. The inner sheath is made of PE and is identical for both static and dynamic umbilicals.

Modulus of elasticity $E_{is}$=600 MPa 5.2.5 Outer sheath 11

The static umbilical has an outer sheath of PE extruded outside the hydraulic lines and the electrical cables, while PU is used for the dynamic section.

| | | |
|---|---|---|
| Modulus of elasticity | $E_{os1}$ = 600 MPa | Polyethylene |
| Modulus of elasticity | $E_{os2}$ = 90 MPa | Polyurethane |

5.3 Umbilical 1, 101, 201 build up 5.3.1 Static umbilical

1: Center filler 4: 4 off profiled filler designed to separate the center tubes. The filler will be coated with an oil film prior to cabling in order to minimise the friction between the filler and the tubes.

2: Center tubes 2: 3 off Super Duplex tubes cabled in helical configuration, lay angle 12.5°. This gives considerably lower MBR compared to one larger center tube.

3: Circular filler 5a, 5b, 5c: 3 off high density PE filler designed to support the PE sheating. Its high density nature gives a lower friction towards the tubes than a softer low density filler.

4: Extruding tape 7: Designed to totally cover the tube and filler bundle in order to be a bed for the PE inner sheath extruding.

5: Inner PE sheath 6: Designed to encapsulate the center tubes and provide a good bed for the cabling of the outer tubes and quads.

6: Outer tubes 9: 9 off Super Duplex outer tubes cabled in helical configuration, lay angle 11°. This will plastic deform the tubes.

7: El. quads 8: 7 off 6 mm2 quads with Ø0.9 mm armour wires. They have the same cabling properties as the outer tubes above.

8: Circular filler 10: 2 off circular fillers with the same outer diameter as the quads. Designed to separate the tubes and give the cabled layer a good fill.

9: Oil film: Oil film applied to the tubes, quads, and the two circular fillers in order to give low friction towards the pressure extruded outer sheath.

10: Outer sheath 11: Pressure extruded PE outer sheath with a minimum of 5 mm thickness. Designed to support the cabled items 5.3.2 Dynamic umbilical The dynamic umbilical comprice of a static umbilical with the following additional layers.

11. Steel tape 112: 4 layers applied in open spiral to obtain umbilical weight/diameter requirement.

12. Outer sheath 11: Extruded PU outer sheath.

5.4 Materials

All materials that the umbilical elements are made of are described in TD258M51, "Umbilical Material Specification".

6. Calculations 6.1 Umbilical weight calculations

The purpose of the weight calculations is not only to determine weight of the umbilical in air and sea water, but also to use these parameters in further analyses and to be a basis when setting requirements to i.e. handling/installation equipment and operations.

In the attached calculation sheet Weight.XLS, weights of the umbilicals include filled lines.

6.2 Umbilical stiffness calculations

Axial stiffness:

The umbilical axial stiffness (AE) is calculated for each element and superposed. Radial deformation of the core for each element layer is ignored in the stiffness calculation, i.e. the calculated axial stiffness is the upper bound stiffness. The true stiffness will be some lower due to radial deformation of the umbilical.

Axial stiffness of static section: $AE_{stat}$=TBA N

Axial stiffness of dynamic section: $AE_{dyn}$=TBA N

Bending stiffness:

Two calculation models are used to estimate the umbilical bending stiffness upper and lower bound. The upper bound is calculated in a infinite friction model by using Steiner's theorem to calculate the moment of inertia and thereby find the bending stiffness. This gives a bending stiffness of $Ei_U$= TBA $kNm^2$ for the static section and TBA $kNm^2$ for the dynamic section.

The lower bound is calculated by a frictionless model as plate springs where the bending stiffness for each element is calculated and superposed. This calculation model gives a lower bound $EI_L$=44 $kNm^2$ for the static section and $EI_L$= TBA $kNm^2$ For the dynamic section.

The bending stiffness of the dynamic umbilical is assumed to be highest in the initial stage of the umbilical service life and to decrease during service life due to reduced internal friction caused by wear and lubrication.

For bending stiffness calculation see EI-CROSS.MCD attached.

Torsional stiffness:

The torsional stiffness has been calculated according to the linear method described in an article of R. H. Knapp.

Static section: TBA $Nm^2$

Dynamic section: TBA $Nm^2$

Introduction

Torsional stiffness has been calculated according to the linear theory described by R. H. Knapp in "Derivation of a new stiffness matrix for helically armoured cables considering tension and torsion". The stiffness matrix has been developed for straight cable elements subjected to tension and torsion.

Ref Knapp "The equations of equilibrium were first derived to include 'internal' geometric non-linearities produced by large deformations (axial elongation and rotation) of a straight element. These equations have then been linearized in a consistent manner to give a linear stiffness matrix. Linear elasticity is assumed throughout. Excellent agreement with experimental results for . . . different cables validates the correctness of the analysis."

Assumptions 1) the derived equations are valid for straight cable elements 2) the diameter of the wire (element) is small in comparison with the pitch length of the helix 3) plane sections of the cross section remain plane before and after deformation 4) the helical wires (elements) in any layer are equally spaced around the circumference of the cable 5) the helical wires (elements) and core elements are homogeneous, isotropic and linear elastic 6) reductions of wire (element) diameter due to interwire contact are neglected 7) cable (umbilical) elongation and rotation strain parameters are assumed to be considerably less than unity ($\delta_c$, $\gamma_i$<<1)

6.3 Umbilical stability calculations

Torque balance

The torque balance is calculated for an infinitely long cable without end conditions. For a fully torque balanced umbilical the torque balanced shall be between 98% and 102% (these boundaries can not be closer to 100% due the tolerances of parameters as lay length, lay angle, el. cable radius which influences the Torque balance):

Note! The torque balance factor TB is taken from "FINAL REPORT, NR0047/005", equation 6, page 16. The radial contraction, ν, in this equation has been neglected.

The KOS/Statoil agreement umbilical is not fully torque balanced. This will result in some twisting until torsion balance is reached of an umbilical under tension. The umbilical is designed to withstand this twisting.

6.4 Steel tube stress calculations

The steel tube design pressure calculations are based on TBK 5–6 "General rules for piping system" worked out of the Norwegian pressure vessel committee. In addition to the calculations according to TBK 5–6 the real tube stress are calculated.

Tube design pressure calculations:

For tube design pressure calculations see the following attatched spread sheets.

Methanol tube: Tube517.mcd

Hydraulic tube: tube690.mcd

Calculation of tube stress:

Calculate tube stress for thick-walled tubes with uniform internal pressure in all directions and ends capped according to Roark's Formulas for stress and strain, sixth edition, table 32.lb page 638.

For tube stresses the following attatched spread sheets:

Methanol: Tubestr.mcd

Hydraulic: tubesth.mcd 6.5 Minimum umbilical bend radius

The tube stresses are calculated in accordance to R. H. Knapp's model described in "Helical wire stresses in bent cable" published in 1987.

The minimum bending radius is depending on the umbilical tension and is calculated to be as shown in the table below.

| MBR for $\epsilon = 0.3\%$ | Friction correction factor | |
|---|---|---|
| Tension [kN] | c = 1 | c = 1.3 |
| 0 | 5.75 | 7.5 |
| 50 | 6.3 | 8.3 |
| 100 | 6.8 | 9.4 |
| 150 | 7.5 | 10.8 |
| 200 | 8.4 | 12.6 |

Minimum bending radius for the umbilical is set to 6.75 m for umbilical with zero tension and will be larger with increased tension.

6.6 Umbilical breaking load

For breaking load calculation input data see section 6.3 "Umbilical stability".

Minimum breaking loads for static and dynamic sections are calculated at the end terminations with outer layer of steel tubes free to slide. The umbilical breaking load will be to some extent higher a distance from the end terminations due to load distribution between the two layers of steel tubes.

Minimum breaking load at end terminations is calculated above to be:

$$F_{break} = 594 \text{ kN}$$

I claim:

1. Arrangement in a cable, especially a hydro electric control cable, comprising in combination a plurality of hydraulic tubes and electrical cables, characterized in that the cable is designed as an umbilical (1, 101, 201) with three centrally arranged tubes (2) in helical configuration which are surrounded by the ring of electric cables (8) and hydraulic tubes (9) to allow for lower minimum bend radius (MBR).

2. Arrangement as claimed in claim 1, characterized in that the three central tubes (2) are supported by a single profiled centre filler (4) having a cross-section like a three-armed star, possibly covered with an oil film prior to cabling.

3. Arrangment as claimed in claim 2, characterized in that the three central tubes (2) are further supported by three filler means (5*a*–5*c*) shaped so as to define a circular section there around and for supporting an inner sheathing (6) and possibly an extruding tape (7) defining a bed for said sheathing (6).

4. Arrangement as claimed in claim 2, characterized in that the three inner central tubes (2) are surrounded by the ring of electric cables (8) and hydraulic tubes (9), preferably of smaller diameter than said inner central tubes (2).

5. Arrangment as claimed in claim 2, characterized in that the three inner central tubes (2) are surrounded by the ring of electric cables (8) and hydraulic tubes (9), wherein the outer diameter of each of said electric cables (8) is larger than the outer diameter of each of said hydraulic tubes (9), and wherein are arranged fillers (10) supporting individually said electric cables (8) and said hydraulic tubes (9) as well as an outer sheath or an intermediate sheath (11).

6. Arrangement as claimed in claim 2, characterized in that for application as a dynamic umbilical, said three central tubes (2) and said ring of electrical cables (8) and hydraulic tubes (9) are provided with a number of outer helically wound layers of metal tape (112; 212) to achieve required weight/diameter ratio, for example applied directly to a static length (FIG. 2 and FIG. 3) for a desired dynamic length, and possibly being provided with an outer sheath of extruded ployurethane (113; 213).

7. Arrangement as claimed in claim 1, characterized in that the three central tubes (2) are further supported by three filler means (5*a*–5*c*) shaped so as to define a circular section there around and for supporting an inner sheathing (6) and possibly an extruding tape (7) defining a bed for said sheathing (6).

8. Arrangement as claimed in claim 7, characterized in that the three inner central tubes (2) are surrounded by the ring of electric cables (8) and hydraulic tubes (9), preferably of smaller diameter than said inner central tubes (2).

9. Arrangment as claimed in claim 7, characterized in that the three inner central tubes (2) are surrounded by the ring of electric cables (8) and hydraulic tubes (9), wherein the outer diameter of each of said electric cables (8) is larger than the outer diameter of each of said hydraulic tubes (9), and wherein are arranged fillers (10) supporting individually said electric cables (8) and said hydraulic tubes (9) as well as an outer sheath or an intermediate sheath (11).

10. Arrangement as claimed in claim 7, characterized in that for application as a dynamic umbilical, said three central tubes (2) and said ring of electrical cables (8) and hydraulic tubes (9) are provided with a number of outer helically wound layers of metal tape (112; 212) to achieve required weight/diameter ratio, for example applied directly to a static length (FIG. 2 and FIG. 3) for a desired dynamic length, and possibly being provided with an outer sheath of extruded ployurethane (113; 213).

11. Arrangement as claimed in claim 1, characterized in that the three inner central tubes (2) are surrounded by the ring of electric cables (8) and hydraulic tubes (9), preferably of smaller diameter than said inner central tubes (2).

12. Arrangment as claimed in claim 11, characterized in that the three inner central tubes (2) are surrounded by the ring of electric cables (8) and hydraulic tubes (9), wherein the outer diameter of each of said electric cables (8) is larger than the outer diameter of each of said hydraulic tubes (9), and wherein are arranged fillers (10) supporting individually said electric cables (8) and said hydraulic tubes (9) as well as an outer sheath or an intermediate sheath (11).

13. Arrangement as claimed in claim 11, characterized in that for application as a dynamic umbilical, said three central tubes (2) and said ring of electrical cables (8) and hydraulic tubes (9) are provided with a number of outer helically wound layers of metal tape (112; 212) to achieve required weight/diameter ratio, for example applied directly to a static length (FIG. 2 and FIG. 3) for a desired dynamic length, and possibly being provided with an outer sheath of extruded ployurethane (113; 213).

14. Arrangment as claimed in claim 1, characterized in that the three inner central tubes (2) are surrounded by the ring of electric cables (8) and hydraulic tubes (9), wherein the outer diameter of each of said electric cables (8) is larger than the outer diameter of each of said hydraulic tubes (9), and wherein are arranged fillers (10) supporting individually said electric cables (8) and said hydraulic tubes (9) as well as an outer sheath or an intermediate sheath (11).

15. Arrangement as claimed in claim 14, characterized in that for application as a dynamic umbilical, said three central tubes (2) and said ring of electrical cables (8) and hydraulic tubes (9) are provided with a number of outer helically wound layers of metal tape (112; 212) to achieve required weight/diameter ratio, for example applied directly to a static length (FIG. 2 and FIG. 3) for a desired dynamic length, and possibly being provided with an outer sheath of extruded ployurethane (113; 213).

16. Arrangement as claimed in claim 1, characterized in that for application as a dynamic umbilical, said three central tubes (2) and said outer ring of electrical cables (8) and hydraulic tubes (9) are provided with a number of outer helically wound layers of metal tape (112; 212) to achieve required weight/diameter ratio, for example applied directly to a static length (FIG. 2 and FIG. 3) for a desired dynamic length, and possibly being provided with an outer sheath of extruded polyurethane (113; 213).

* * * * *